United States Patent [19]

Beckley

[11] Patent Number: 4,652,316

[45] Date of Patent: Mar. 24, 1987

[54] PRODUCTION OF GRAIN ORIENTED STEEL

[75] Inventor: Philip Beckley, Gwent, Wales

[73] Assignee: British Steel Corporation, London, England

[21] Appl. No.: 645,834

[22] Filed: Aug. 31, 1984

[30] Foreign Application Priority Data

Sep. 14, 1983 [GB] United Kingdom ..... 8324643

[51] Int. Cl.[4] ..... H01F 1/04

[52] U.S. Cl. ..... 148/112; 148/121; 148/111

[58] Field of Search ..... 148/110, 111, 112, 113, 148/120, 121, 122, 154; 219/10.43, 155, 121 R, 121 EG, 121 EM, 121 PB, 121 PY

[56] References Cited

U.S. PATENT DOCUMENTS

| | | | |
|---|---|---|---|
| 3,240,639 | 3/1966 | Lihl | 148/150 |
| 3,281,289 | 10/1966 | Gordon et al. | 148/108 |
| 4,293,350 | 10/1981 | Ichiyama et al. | 148/111 |
| 4,554,029 | 11/1985 | Schoen et al. | 148/112 |

FOREIGN PATENT DOCUMENTS

| | | | |
|---|---|---|---|
| 58-144424 | 8/1983 | Japan | 148/111 |
| 652230 | 3/1979 | U.S.S.R. | 148/112 |

*Primary Examiner*—John P. Sheehan

*Attorney, Agent, or Firm*—Kinney & Lange

[57] ABSTRACT

The invention provides a method of treating grain oriented steel sheet or strip to refine domain spacing by subjecting the steel sheet or strip to electrical discharge to create a line of surface ablation and stress thereacross, together with apparatus for carrying out the method.

9 Claims, 1 Drawing Figure

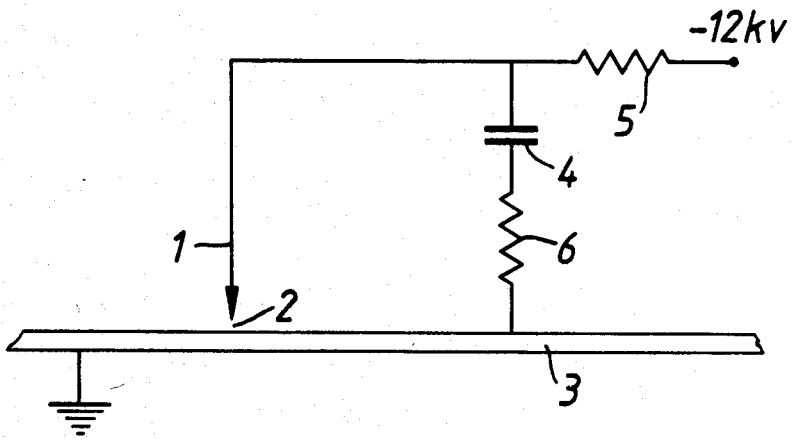
-12kv
5
4
6
1
2
3

PRODUCTION OF GRAIN ORIENTED STEEL

This invention relates to the production of grain orientated steel.

Sheet or strip of grain orientated steel for electrical purposes is of course well known. Such sheet or strip is used for electromagnetic applications eg. to form a magnetic circuit in electric machines. The sheet or strip is typically produced from steel containing silicon typically in concentrations within the range 2–4% weight. Processing of the silicon steel by working and thermal treatment in known manner promotes preferential growth of some grains within the steel in order to obtain large grains having predominantly (110)[001] Miller Indices and to inhibit the growth of the remaining grains. This of course leads to strong orientation of the grains with strongly enhanced magnetic characteristics for the purposes for which the steel is intended.

A problem associated with the production of such grain orientated steel is that production of optimum alignment of the grain leads at the same time to grains of a larger than optimum size. Such large grain size leads to significant power loss problems. Magnetic domain wall spacing within the grains becomes large so that in use rapid movement of the domain walls (caused by the greater distance to be moved by the domain walls in unit time) create severe micro-eddy currents, in turn causing power losses.

It has been proposed to overcome this problem by the provision of artificial barriers intended to simulate the effect of grain boundaries in the steel sheet or strip and therefore to refine, or reduce, the domain spacing so as to reduce movement of the domain walls.

It is an object of the present invention to provide an improved method of and apparatus for creating such artificial barriers.

In accordance with one aspect of the invention there is provided a method of treating grain orientated steel sheet or strip to refine domain spacing by subjecting the steel sheet or strip to electrical discharge to create a line of surface ablation and stress thereacross.

In accordance with another aspect of the present invention there is provided apparatus for treating grain orientated steel sheet or strip to refine the domain spacing comprising an electric discharge probe adapted to be located above the surface of a grain orientated sheet or strip and means for causing the probe to discharge so as to create a line of surface ablation and stress on the sheet or strip.

The line of ablation can be constituted by a succession of discharge spots, or alternatively a continuous line of ablation can be created. We have found that with electrical steel sheet or strip of the kind to which this invention relates, typically having a thickness of between 0.20 to 0.35 mm, the line of ablation created by the discharge provides a simulated grain boundary effect through the thickness of the metal. Thus the discharge creates atomic magnitude disruption at and below the metal surface, and in addition a thermal stress field is set up below the surface through the thickness of the sheet or strip effective as a simulated grain boundary.

BRIEF DESCRIPTION OF THE DRAWING

The drawing shows diagrammatically the arrangement of a discharge probe above a grain oriented steel sheet in order that the invention may be more readily understood one embodiment thereof will now be described by way of example with reference to the accompanying drawing.

The probe 1 is located with a gap 2 of between 2 and 3 mm above the surface of the sheet 3 which is of a thickness between 0.20 and 0.35 mm (although the gap 2 can be less, for example down to 0.5 mm) and is raised to a high voltage supply of −12 KV with respect to the sheet in order to cause a spark to discharge from the probe to the sheet. The voltage for discharge will be of the order of 3000 to 10,000 volts. It is to be observed that although grain orientated electrical steel carries an insulating coating as a matter of course, high voltage of this magnitude, necessary for the spark to traverse the air gap between the probe and the steel sheet, will also be quite adequate to effect the breakdown of the insulating coating. A gap of between 1 to 3 mm is sufficiently large to enable a relative constancy of spacing between the probe and the sheet to be maintained during movement of the probe relative to the sheet.

A capacitor 4 is connected between the probe and the sheet, the capacitor being of a moderate size, for example somewhere between 1000 and 10,000 pf. In this case then the energy delivered is of the order of $\frac{1}{2}CV^2$ joules where C is the capacitance of the capacitor and V is the voltage across the gap between the probe and the sheet. It is to be noted that regulation of the gap between the probe and the sheet (and thus the discharge voltage) or the capacitance of the capacitor will enable regulation of the delivered energy.

A circuit of the kind illustrated in the FIGURE will act in practise as a relaxation oscillator so that spark discharge will occur at the rate related to a time constant R, where R is the resistance of a resistor 5 connected in the power supply line, and the relaxation between the power supply of 12 KV and the breakdown potential of the gap between the probe and the sheet. Regulation of the energy delivery rate can also be controlled by regulation of the value given to a low value resistor 6 connected in series with the capacitor 4.

Adjustment of the gap 2 between probe 1 and sheet 3, the value of the capacitor 4, the value of the large resistor 5, the value of the power supply, and the value of the small resistor 6 give a very wide control of the production of ablation spots from the discharge. If the probe is moved in line along or across the sheet a line of ablation spots, producing a barrier wall simulating the effect of a grain boundary will be produced, this barrier wall acting as a domain spacing refining system. Clearly the probe can be moved successively across the sheet to produce a succession of such lines and a domain spacing refining system throughout the sheet.

In an alternative arrangement a continuous arc discharge can be produced so that a continuous line of ablation can be drawn across the surface of the sheet.

Again, if desired as an alternative the discharge spots can be provided at a fixed power supply by use of a trigger mechanism to discharge the capacitor rather than rely on the natural breakdown voltage of the gap between the probe and the sheet.

It is to be noted that in practise it is desirable, as illustrated, to utilise a negative potential on the probe so as to reduce probe erosion, which otherwise could be quite severe.

A multiple array of probes can be utilised for simultaneous actuation, the probes being spaced a predetermined distance apart and moved together across the sheet. The spacing of the probes in this case would be such as to apply lines of barrier walls at a spacing found to be most suitable for the particular grain orientated steel concerned.

We have found that the arrangement according to the invention herein described enables an inexpensive and simple creation of artificial grain boundaries. We believe that improvements to the core loss properties of electrical steels with good grain orientation can be up to 15% as indicated by the data given in the Table set out below, and the examples therefollowing.

The losses referred to in the following table 1 part B are measured at an induction of 1.7 Tesla and 50 Hertz.

TABLE 1

DATA RELATED TO ABLATED SAMPLES

| EXAMPLE | ABLATION CONDITIONS: ELECTRODE/STRIP GAP (mm) | ABLATION CONDITIONS: TRAVERSE RATE OF ELECTRODE ACROSS STRIP (cm/sec) | RESISTANCE (kΩ) | CAPITANCE (pF) |
|---|---|---|---|---|
| 1 | 1.81 | 0.5 | 1000 | 2500 |
| 1A | " | " | " | " |
| 1B | " | " | " | " |
| 2 | 0.86 | 0.5 | 1000 | 2500 |
| 2A | " | " | " | " |
| 2B | " | " | " | " |
| 3 | 1.14 | 0.5 | 5000 | 2500 |
| 3A | " | " | " | " |
| 3B | " | " | " | " |
| 4 | 1.14 | 0.5 | 200 | 2500 |
| 4A | " | " | " | " |
| 4B | " | " | " | " |
| 5 | 1.14 | 5.0 | 1000 | 2500 |
| 5A | " | " | " | " |
| 5B | " | " | " | " |
| 5C | " | " | " | " |
| 6 | 1.14 | 10.0 | 1000 | 5000 |
| 6A | " | 10.0 | 1000 | 2500 |
| 7 | 0.42 | 2.5 | 1000 | 2500 |
| 8 | 2.2 | 2.5 | 1000 | 2500 |

| EXAMPLE | PERMEABILITY | INITIAL LOSS (W/kg) | LOSS AFTER SCRIBING AT 0.5 cm LINE SPACING (W/kg) | % CHANGE IN LOSS AT 1.0 cm | % CHANGE IN LOSS AT 0.5 cm |
|---|---|---|---|---|---|
| 1 | 1.96 | 1.276 | 1.148 | 7.1 | 10.0 |
| 1A | 1.93 | 1.301 | 1.173 | 8.1 | 9.8 |
| 1B | 1.93 | 1.200 | 1.131 | 4.8 | 5.8 |
| 2 | 1.96 | 1.242 | 1.044 | 11.9 | 15.9 |
| 2A | 1.96 | 1.216 | 1.077 | 9.3 | 11.4 |
| 2B | 1.93 | 1.247 | 1.125 | 7.1 | 9.8 |
| 3 | 1.96 | 1.314 | 1.170 | 6.7 | 11.0 |
| 3A | 1.96 | 1.105 | 1.019 | 5.0 | 7.8 |
| 3B | 1.93 | 1.175 | 1.069 | 6.8 | 9.0 |
| 4 | 1.96 | 1.288 | 1.137 | 8.9 | 11.7 |
| 4A | 1.96 | 1.111 | 1.022 | 6.9 | 8.0 |
| 4B | 1.96 | 1.075 | 1.027 | 2.9 | 4.5 |
| 5 | 1.93 | 1.143 | 1.043 | — | 9.1 |
| 5A | 1.93 | 1.340 | 1.180 | — | 11.9 |
| 5B | 1.93 | 1.270 | 1.173 | — | 7.7 |
| 5C | 1.93 | 1.250 | 1.155 | 5.6 | 7.6 |
| 6 | 1.96 | 1.172 | 1.086 | — | 7.3 |
| 6A | 1.93 | 1.249 | 1.130 | 5.8 | 8.9 |
| 7 | 1.93 | 1.190 | 1.134 | — | 7.0 |
| 8 | 1.93 | 1.320 | 1.230 | — | 6.8 |

NOTE: The above data relates to Epstein samples of HiB type material

EXAMPLE 1

An Epstein sample of Hi B type grain oriented silicon steel was scribed by the method described above using an electrode/strip gap of 1.81 mm, a resistor of value 1MΩ, a capacitor of value 2500 pF, and a traverse rate of electrode across the strip of 0.5 cm/sec.

Prior to treatment the permeability of the sample was 1.96 and the power loss was 1.276 W/kg. After treatment the loss value was reduced by 10.0% to a value of 1.148 W/kg.

Other samples treated under similar conditions exhibited loss reduction values of 9.8 and 5.8% (Examples 1A and 1B in Table 1).

EXAMPLE 2

An Epstein sample of Hi B type grain oriented silicon steel was scribed by the method described above using an electrode/strip gap of 0.86 mm, a resistor of value 1MΩ, a capacitor of value 2500 pF, and a traverse rate of electrode across the strip of 0.5 cm/sec.

Prior to treatment the permeability of the sample was 1.96 and the power loss was 1.242 W/kg. After treatment the loss value was reduced by 15.9% to a value of 1.044 W/kg.

Other samples treated under similar conditions exhibited loss reduction values of 11.4 and 9.8% (Examples 2A and 2B in Table 1).

The ablation energy in this case was lower than that employed in Example 1 as indicated by the lower electrode/strip gap (0.86 mm compared to 1.81 mm).

In the following Examples 3–6, an ablation energy between those employed in Examples 1 and 2 was utilised as indicated by the electrode/strip gap of 1.14 mm. In addition, different pulse rates were employed from that used in Examples 1 and 2, as indicated by the use of different resistor values, capacitor values and traverse rates of electrode across the strip.

EXAMPLE 3

An Epstein sample of Hi B type grain oriented silicon steel was scribed by the method described above using an electrode/strip gap of 1.14 mm, a resistor of value 5MΩ, a capacitor of value 2500 pF, and a traverse rate of electrode across the strip of 0.5 cm/sec.

Prior to treatment the permeability of the sample was 1.96 and the power loss was 1.314 W/kg. After treatment the loss value was reduced by 11.0% to a value of 1.170 W/kg.

Other samples treated under similar conditions exhibited loss reduction values of 7.8 and 9.0% (Examples 3A and 3B in Table 1).

EXAMPLE 4

An Epstein sample of Hi B type grain oriented silicon steel was scribed by the method described above using an electrode/strip gap of 1.14 mm, a resistor of value 200 kΩ, a capacitor of value 2500 pF and a traverse rate of electrode across the strip of 0.5 cm/sec.

Prior to treatment the permeability of the sample was 1.96 and the power loss was 1.288 W/kg. After treatment the loss value was reduced by 11.7% to a value of 1.137 W/kg.

Other samples treated under similar conditions exhibited loss reduction values of 8.0, and 4.5% (Examples 4A and 4B in Table 1).

EXAMPLE 5

An Epstein sample of Hi B type grain oriented silicon steel was scribed by the method described above using an electrode/strip gap of 1.14 mm, a resistor of value 1MΩ, a capacitor of value 2500 pF, and a traverse rate of electrode across the strip of 0.5 cm/sec.

Prior to treatment the permeability of the sample was 1.93 and the power loss was 1.148 W/kg. After treatment the loss value was reduced by 9.1% to a value of 1.043 W/kg.

Other samples treated under similar conditions exhibited loss reduction values of 11.9 and 7.6% (Examples 5A, 5B and 5C in Table 1).

EXAMPLE 6

An Epstein sample of Hi B type grain oriented silicon steel was scribed by the method described above using an electrode/strip gap of 1.14 mm, a resistor of value 1MΩ, a capacitor of value 2500 pF, and a traverse rate of electrode across the strip of 10 cm/sec.

Prior to treatment the permeability of the sample was 1.96 and the power loss was 1.172 W/kg. After treatment the loss value was reduced by 7.3% to a value of 1.086 W/kg.

Another sample treated under similar conditions exhibited a loss reduction value of 8.9% (Example 6A in Table 1).

The following Examples 7 and 8 give data for higher and lower ablation energies than employed in Examples 1–6, as indicated by the values of electrode/strip gap, 0.42 and 2.2 mm compared to 0.86–1.81 mm.

EXAMPLE 7

An Epstein sample of Hi B type grain oriented silicon steel was scribed by the method described above using an electrode/strip gap of 0.42 mm, a resistor of value 1MΩ, a capacitor of value 2500 pF, and a traverse rate of electrode across the strip of 2.5 cm/sec.

Prior to treatment the permeability of the sample was 1.93 and the power loss was 1.190 W/kg. After treatment the loss value was reduced by 7.0% to a value of 1.134 W/kg.

EXAMPLE 8

An Epstein sample of Hi B type grain oriented silicon steel was scribed by the method described baveo using an electrode/strip gap of 2.2 mm, a resistor of value 1MΩ, a capacitor of value 2500 pF, and a traverse rate of electrode across the strip of 2.5 cm/sec.

Prior to treatment the permeability of the sample was 1.93 and the power loss was 1.320 W/kg. After treatment the loss value was reduced by 6.8% to a value of 1.230 W/kg.

I claim:

1. A method of treating grain oriented steel sheet or strip to refine domain spacing by subjecting the steel sheet or strip to a succession of spark discharges to create a line of surface ablation and stress thereacross, the succession of spark discharges being created by a probe separated from the sheet or strip by between 1 and 3 mm and having a voltage for each discharge applied thereto of between about 3,000 and about 10,000 volts.

2. A method as claimed in claim 1 wherein the line of ablation is constituted by a succession of dischage spots.

3. A method as claimed in claim 1 wherein the probe is moved relatively across the sheet or strip to produce a line of ablation spots.

4. A method as claimed in claim 3 wherein the probe is moved successively relatively across the sheet or strip to produce a succession of lines of ablation spots and thereby a domain spacing refining system throughout the sheet or strip.

5. A method as claimed in claim 1 wherein a continuous line of ablation is created.

6. A method as claimed in claim 5 wherein the electrical discharge is provided by a continuous arc discharge.

7. A method as claimed in claim 1 having a capacitor connected between the probe and the steel sheet or strip of a capacitance between 1,000 and 10,000 pF.

8. A method of treating grain oriented sheet steel or strip at a surface thereof to refine domain spacing by positioning a probe separated from the surface of the sheet or strip by between 1 and 3 mm with a voltage source electrically connected thereto, and ablating portions of the surface region of the sheet or strip by spark discharge between the probe and the surface to disrupt the surface.

9. The method of claim 8 wherein the voltage of the voltage source is between about 3,000 and about 10,000 volts.

* * * * *